US006134812A

United States Patent [19]

Voss

[11] Patent Number: 6,134,812

[45] Date of Patent: Oct. 24, 2000

[54] SHOE SOLE

[75] Inventor: Hans-Christian Voss, Bielefeld, Germany

[73] Assignee: Johann Neuner Metalltechnik-Apparatebau, Mannheim, Germany

[21] Appl. No.: 09/269,879

[22] PCT Filed: Sep. 18, 1997

[86] PCT No.: PCT/EP97/05119

§ 371 Date: Apr. 2, 1999

§ 102(e) Date: Apr. 2, 1999

[87] PCT Pub. No.: WO98/14085

PCT Pub. Date: Apr. 9, 1998

[30] Foreign Application Priority Data

Oct. 2, 1996 [DE] Germany ..... 196 40 655

[51] Int. Cl.[7] ..... A43B 5/04

[52] U.S. Cl. ..... 36/29; 36/3 B; 36/102

[58] Field of Search ..... 36/3 R, 3 B, 102, 36/25 R, 29, 35 B, 153

[56] References Cited

U.S. PATENT DOCUMENTS

| | | | |
|---|---|---|---|
| 2,177,116 | 10/1939 | Persichino | 36/29 |
| 4,312,140 | 1/1982 | Reber | 36/3 B |
| 4,414,760 | 11/1983 | Faiella | 36/29 |
| 5,199,191 | 4/1993 | Moumdjian | 36/29 |
| 5,295,314 | 3/1994 | Moumdjian | 36/29 |
| 5,353,525 | 10/1994 | Grim | 36/29 |
| 5,375,346 | 12/1994 | Cole et al. | 36/29 |
| 5,416,986 | 5/1995 | Cole et al. | 36/29 |
| 5,524,364 | 6/1996 | Cole et al. | 36/29 |
| 5,625,964 | 5/1997 | Lyden et al. | 36/29 |
| 5,706,589 | 1/1998 | Marc | 36/29 |

FOREIGN PATENT DOCUMENTS

| | | | |
|---|---|---|---|
| 200963 | 12/1958 | Austria | 36/153 |
| 116106 | 12/1899 | Germany . | |
| 1195 639 | 6/1965 | Germany . | |
| 33 13 767 | 10/1983 | Germany . | |
| 3701826 | 10/1987 | Germany | 36/29 |
| 30 12 945 | 8/1989 | Germany . | |
| 39 42 777 | 7/1991 | Germany . | |
| 2189679 | 11/1987 | United Kingdom | 36/3 B |

*Primary Examiner*—David T. Fidei
*Assistant Examiner*—Anthony Stashick
*Attorney, Agent, or Firm*—Foley & Lardner

[57] ABSTRACT

A shoe sole which, in the heel and ball regions, comprises deformable cavities which are connected to one another and to the surrounding air by means of lines which can be closed by valves. Provided in the bending region of the sole is a transverse gap which is closed at the bottom and is filled by a further deformable and partially closable cavity which comprises at least one outlet line to the surrounding air and is connected to the cavity in the ball region via a line which can be closed by a valve. When stress is applied to the heel region, the line connecting the cavity in the region to the surrounding air is closed by the valve, the line leading to the cavity in the ball region is opened, the line leading to the cavity in the gap is closed, and the outlet lines in this cavity are open. When the sole is aligned straight as desired by opening the gap, the lines are closed again and the outer line is opened in order to re-establish the state in which the heel region can be stressed again.

15 Claims, 5 Drawing Sheets

SHOE SOLE

The present invention relates to a shoe sole, in the heel region and in the ball-of-the-foot region of which there are air-filled cavities in each case which are connected to one another via a line and valves which damp the impact when the foot is placed on the ground and, in the bending region, have a further cavity, which aids the forward movement.

It is known to provide shoes with elastic foam soles which damp the impact when the foot is placed on the ground. The deformation of the sole which takes place as a result of the foot being placed on the ground, however, requires additional force to be exerted during walking.

It is also known to provide, in the heel region and ball-of-the-foot region of the shoe sole, deformable, air-filled cavities which are connected to one another by lines, in order that, in addition to damping the impact when the foot is placed on the ground, there is also an improvement in the natural rolling movement of the foot. In this case, the air, possibly under elevated pressure, is forced, via the line, directly out of the region which is subjected to loading into the region which is not, this being intended to massage the muscles of the foot as a result. The compression energy is not utilized for forward movement (see German Patent 116 106 and DE-B 11 95 639).

German Patent 30 12 945 describes a shoe sole in which the energy used when the heel is placed on the ground is to be reused in the last phase of the step when the foot leaves the ground. For this purpose, it is provided that the compressed air which, when the heel is placed on the ground, is produced in the first cavity, which is located in this region of the sole, is collected in an intermediate store, from which it is to be directed, via a valve which is initiated by the bending of the shoe sole, into the second cavity, which is located in the ball-of-the-foot region of the sole, in order to inflate said second cavity at the point in time when the foot is lifted off the ground and thus to aid the lifting movement. Since in this position, however, the air in this cavity has already been compressed by the loading of the ball of the foot, on which the entire body weight rests at this point in time, air does not, in practice, flow out of the intermediate store, which is not at a higher pressure.

DE-A 33 13 767 discloses a further insole which is to effect impact damping and heat compensation during walking. In the case of this device, cavities in the ball-of-the-foot region and heel region are in each case connected to the outside air via valves and to one another via a line and a valve. When the sole region is subjected to loading, air flows, via said line and the valve, into the heel region, from where, when the heel region is subjected to loading, it is discharged to the outside air via the valve. While the heel region is subjected to loading and the sole region is relieved of loading, outside air is simultaneously taken in via the valve located in the sole region. The impact damping is regulated by corresponding dimensioning of the through-valves. The impact energy is not utilized here for forward movement either.

DE-B 39 42 777 discloses a further device in which a cavity in the heel region serves for impact damping, the compressed air being routed via lines into the sole region, where it flows out and displaces the humid air collected in the shoe interior. When the heel region is relieved of loading, fresh outside air is taken in from the outside via corresponding valves. It is also the case here that the energy used when the foot is placed on the ground is not utilized for forward movement.

The object of the present invention has thus been to find a device which makes it possible for the forces which are exerted when the foot is placed on the ground to be utilized for aiding the walking action.

This object is achieved by the features of the main claim and by those of the subclaims.

The device according to the invention achieves the situation where on the one hand, in a manner known per se, the impact when the foot, in particular the heel, is placed on the ground is cushioned by air-sealed cavities and, in a novel manner, the energy stored by the compression of the air is utilized in order to force the sole to straighten out, shortly before the foot is lifted off the ground, and thus to impart a forwardly directed impulse to the shoe. In a preferred embodiment, the compressed air is additionally utilized for cooling and drying the shoe interior.

The invention is explained in more detail hereinbelow with reference to the drawings, in which.

Figure 7A:
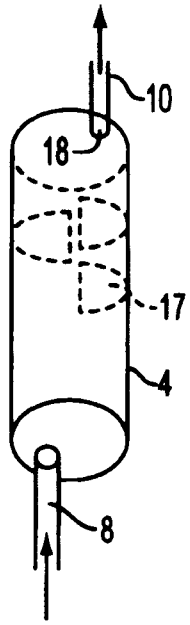
Figure 7B:
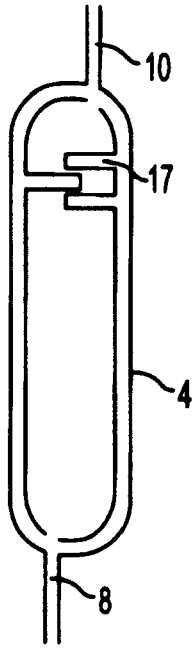
Figure 7C:
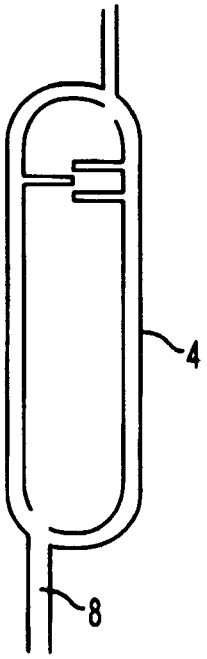
Figure 7D:
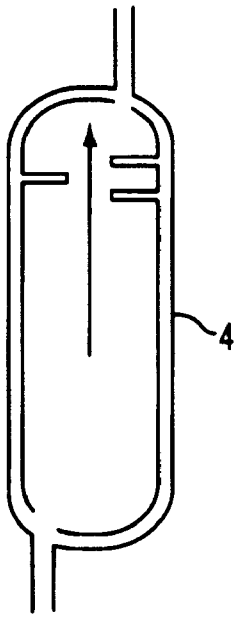
Figure 8:
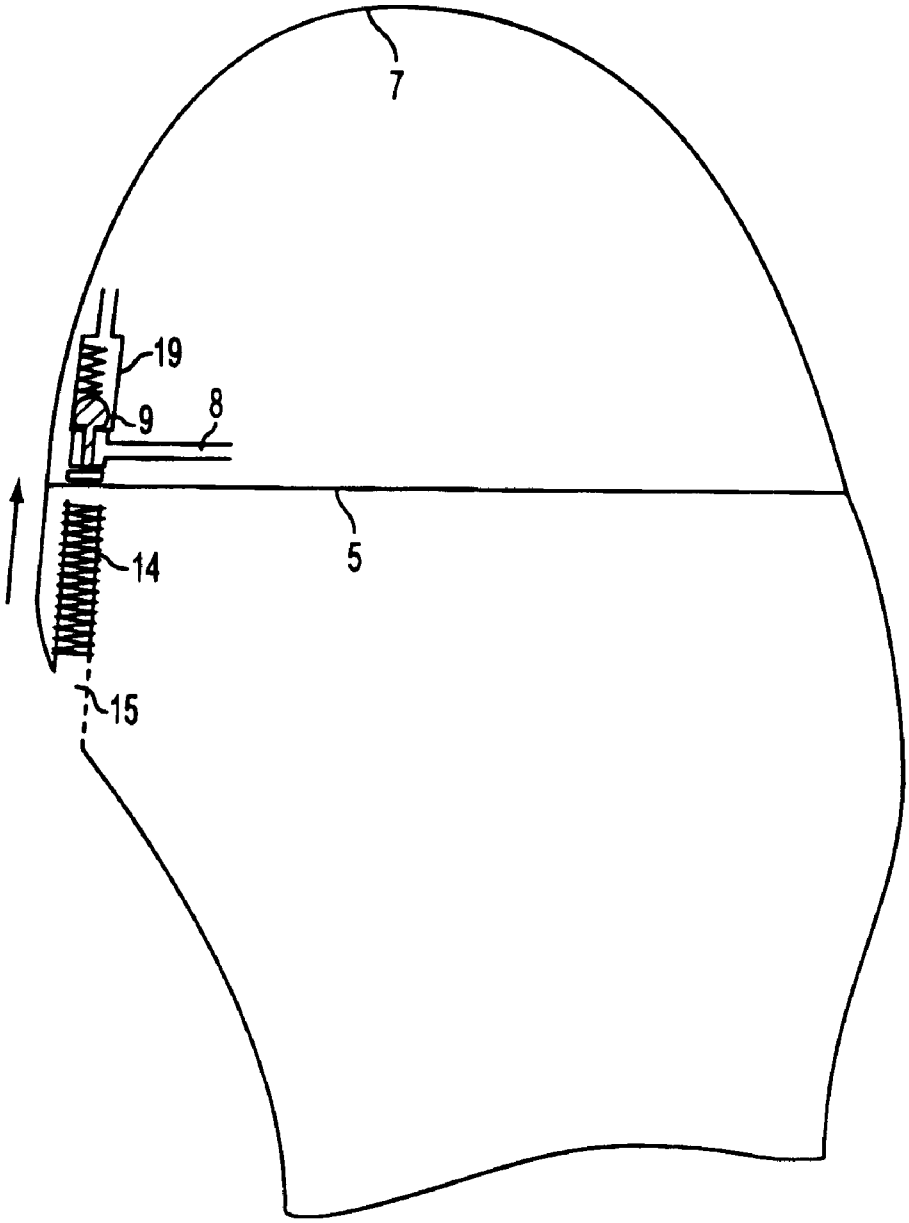

FIGS. 7*a*–7*d* show a mechanism for producing a connection to the outside air, the mechanism being shown at various actuating stages; and FIG. 8 shows the schematic illustration of an initiating mechanism.

Figure 1:
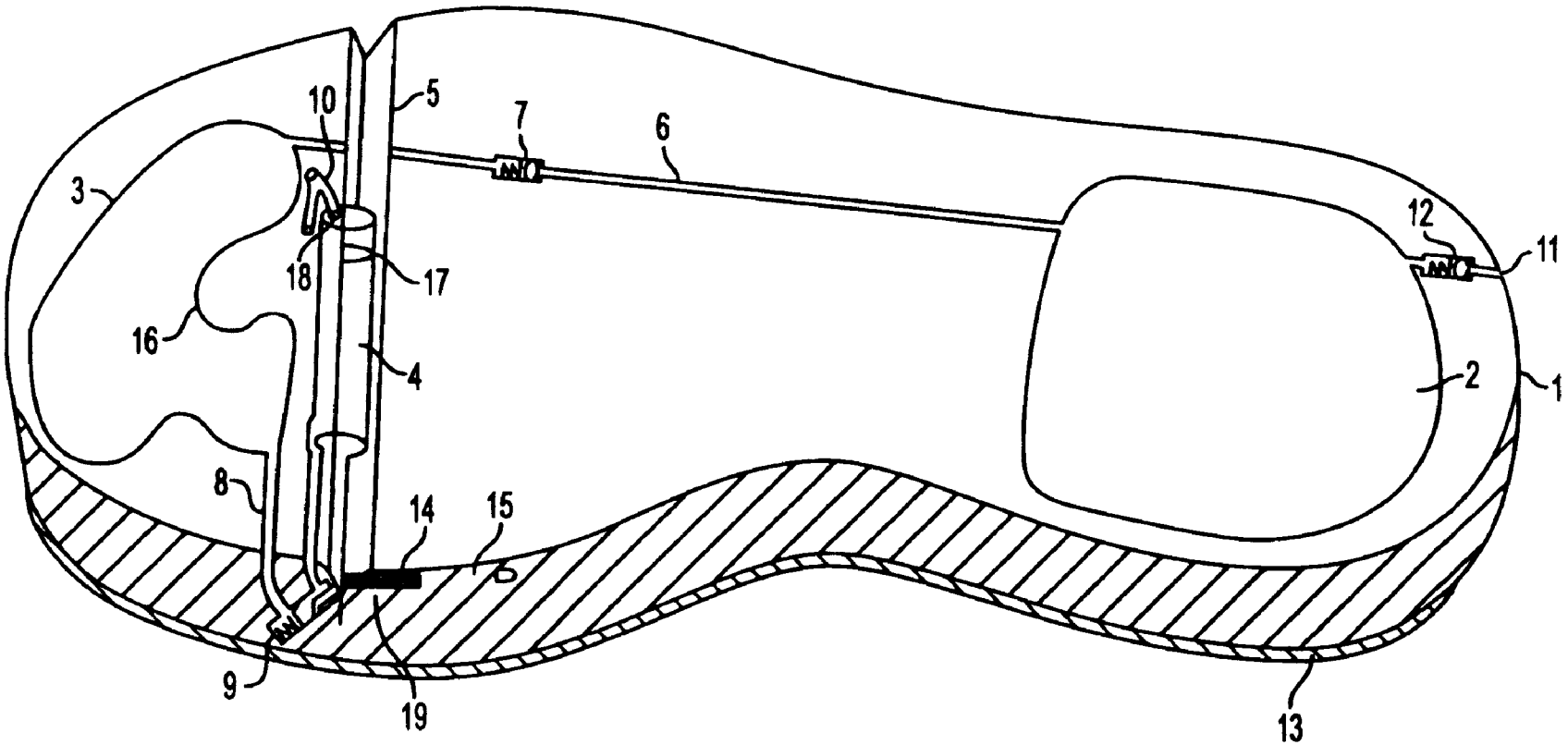
FIG. 1 shows the perspective view of a shoe sole according to the invention.

FIG. 1 shows a shoe with the sole 1 according to the invention, a first cavity in the heel region 2, an intermediate pressure-storage space (second cavity 3) in the ball-of-the-foot region, and a further, third cavity 4 in a gap 5 of the sole 1, said gap being located between the ball-of-the-foot region and heel region. A line 6 with a valve 7 connects the cavities 2 and 3, and a line 8 with a valve 9 connects the cavities 3 and 4. Line 10 and blocking mechanism 17 connect the third cavity 4 to the outside air and/or the shoe interior. A line 11 and a valve 12 connect the first cavity 2 to the outside air. An outsole 13 is provided beneath the sole 1. The initiating mechanism 19 comprising [sic] the valve 9, with its valve housing, the valve spring and the valve pin, as well as the pressure-initiating screw 14. As the sole is bent, the screw 14 in the channel 15 advances toward the valve 9, which is located opposite on the other side of the gap, until pressure initiation takes place. The intermediate pressure-storage space (second cavity 3) advantageously has a configuration 16 which is based on the bearing region of the ball of the foot. The blocking mechanism 17, formed by drawn-in walls, closes off the third cavity 4 in a more or less sealed manner depending on expansion, it being possible for the air to escape, if appropriate, via outlet opening 18 with discharge line 10.

The walls of the various cavities preferably consist of an elastic rubber or plastic.

It is only in exceptional cases, for example when the sole material itself has sufficient strength or gas-tightness, that the walls of the various cavities may be produced from the sole material itself.

Instead of the blocking mechanism 17, it is also possible to provide, in the line 10, a valve which opens when the gap 5 is completely open and closes again as the gap is bent together. It is also possible that the first cavity 2 may optionally be connected to a portable, controllable, positive-pressure oxygen chamber by a valve with a bearing-pressure initiating mechanism including an outwardly leading line.

The valves used are preferably straightforward non-return valves or flap valves which are controlled by the pressure or negative pressure in the respective line. It is only for the valve 9 that it is necessary to provide for control by an initiating mechanism coupled to the bending action of the sole.

Figure 2:
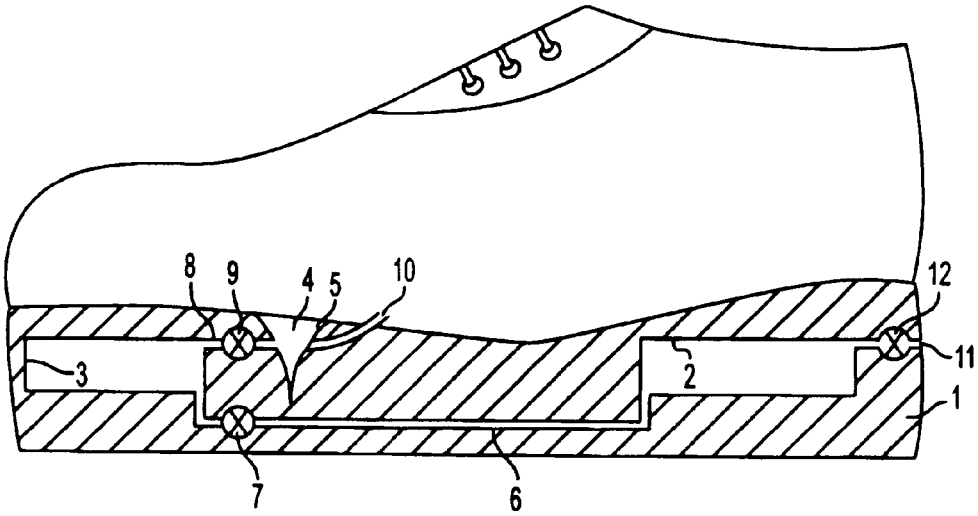
FIG. 2 shows the longitudinal section of a shoe with the shoe sole according to the invention in the non-loaded state.

FIG. 2 shows a shoe with the sole in a state in which none of the cavities is subjected to loading.

Figure 3:
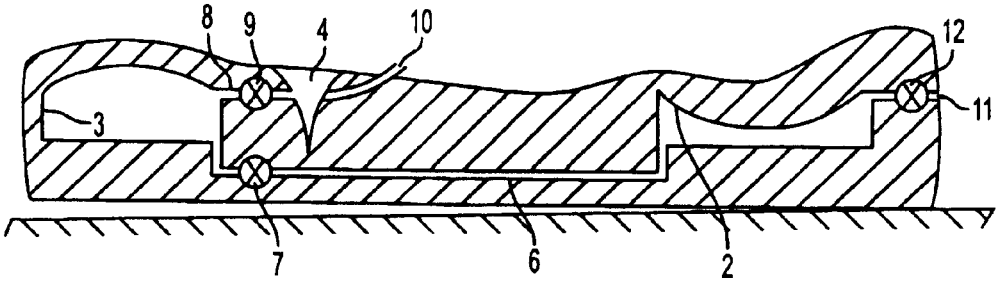
FIG. 3 shows the shoe sole at the point in time when the heel is placed on the ground.

FIG. 3 shows a view of the sole at a point in time when merely the heel region is subjected to loading, with the result that the first cavity 2 is compressed (illustrated by the top wall bulging inward) and air flows via the valve 7, which has been opened by the compression, into the second cavity 3 (illustrated by the top wall bulging outward); at this stage, the valves 12 and 9 are closed. The blocking mechanism 17 is open in this position, with the result that the third cavity 4 is relieved of pressure.

Figure 4:
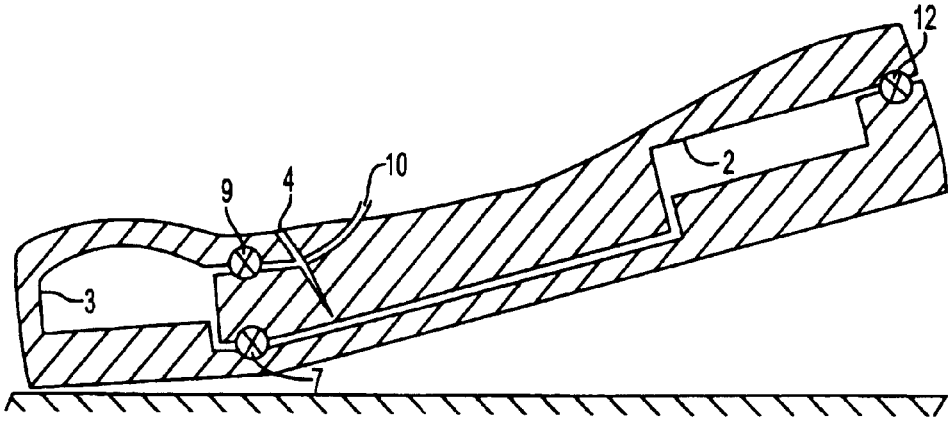
FIG. 4 shows the shoe sole during the rolling operation as the heel is relieved of loading.

FIG. 4 illustrates the point in time at which the heel is lifted off the ground and the body weight is shifted into the ball-of-the-foot region. The discharge of most of the air volume from the third cavity 4 has already been carried out at this stage; the blocking mechanism 17 has been closed by the bending of the sole 1 and the compression of the third cavity 4. The bending movement of the sole, which is associated with the weight being shifted, does not require any additional deformation energy. In this state, the valves 9 and 7 are closed. By virtue of the intermediate pressure-storage space 3 being placed beneath the ball of the foot, the pressure in said second cavity 3 can be increased a second time. Valve 12 is open in this phase, with the result that air can flow into the first cavity 2 from the outside and replaces the air which has previously been discharged into the second cavity 3. By virtue of the predetermined elastic stressing of the walls of the first cavity 2, the release of pressure from the heel region produces a vacuum into which the air overline 11 [sic] flows.

Figure 5:
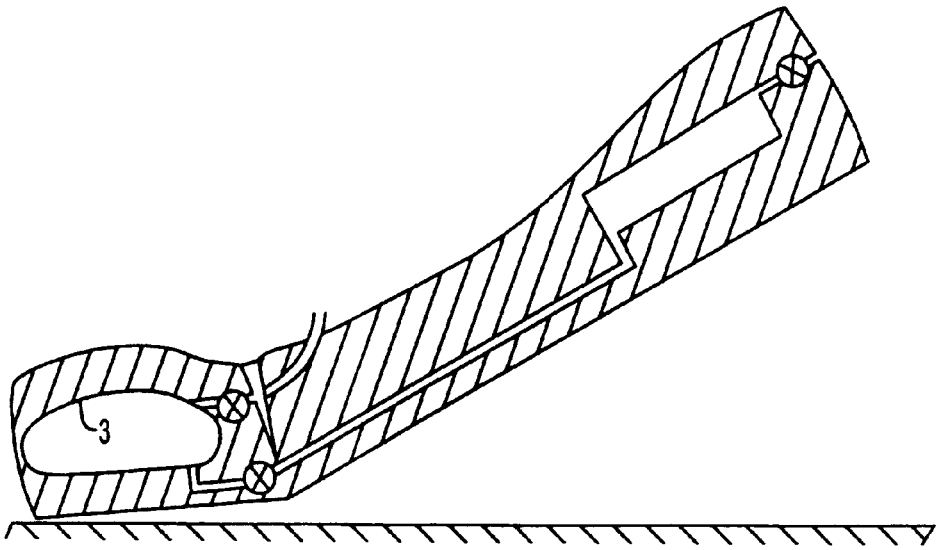
FIG. 5 shows the sole at the stage when the ball of the foot is subjected to loading.

FIG. 5 shows the second compression of the already pre-compressed air by pressure of the ball of the foot on the second cavity 3 (illustrated by the top wall and the side walls bulging outward). This space 3 is adapted anatomically in accordance with the main bearing-pressure points at the level of the center of the ball of the foot and of the ball of the big toe as well as the toes. At this stage, the air which has been compressed twice in this way4 [sic] has just begun, by further bending of the sole 1, to flow further opening valve 9 [sic].

Figure 6:
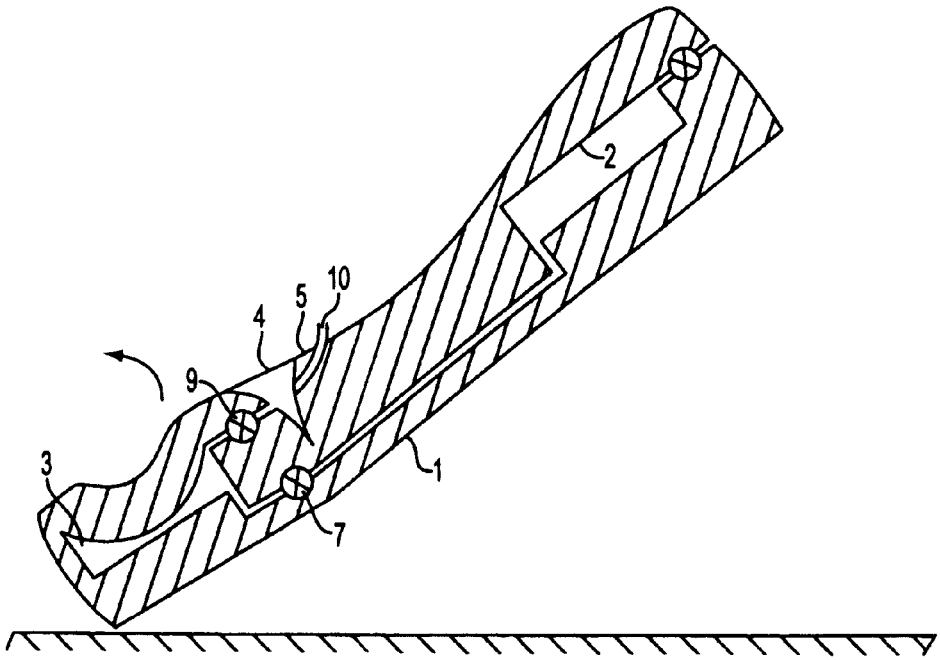
FIG. 6 shows the sole shortly before the foot is lifted off the ground.

FIG. 6 shows the point in time when the sole is lifted off the ground. Valve 9 is open in this position, with the result that the twice-compressed air in the second cavity 3 widens the third cavity 4 and thus forces the gap 5 apart and straightens out the sole 1 again. Valve 7 is closed in this position. As the sole 1 straightens out more and more, the bending-induced initiating pressure on the valve 9 decreases, with the result that it is closed again once the sole has been straightened out.

The dimensions of the cavities 2 and 3 are to be selected such that the compressed air produced therein corresponds approximately to the filling volume of the cavity 3. Relatively small deviations are compensated for by the change in the operating pressure in the cavities 3 and 4.

FIG. 7*a* shows a perspective illustration of the third cavity 4. In order to achieve extended throughflow as expansion increases, it is expedient first of all to place the outlet 18 of the discharge line 10 to the greatest possible extent opposite the inlet of line 8. It is also expedient for the outlet opening 18 to be narrower than the inlet of line 8. The blocking mechanism 17 is indicated by three parallel walls which, when relieved of loading, release an opening.

FIG. 7*b* shows the third cavity 4 in cross section. The cavity is in a compressed state. At this stage, air cannot escape through the wall-like inwardly directed projections of the blocking mechanism 17, said projections interengaging as a result of the compressed state of the cavity 4; in contrast, compressed air flows in from the second cavity 3 via the line 8.

FIG. 7*c* shows the third cavity 4 in a somewhat widened state, once some of the compressed air has been introduced through line 8. The step involving the expansion, and thus widening of the gap, which the third cavity 4 is undergoing is more or less complete at this stage.

FIG. 7*d* shows the third cavity 4 in the fully widened state. The walls of the blocking mechanism 17 are open. A large proportion of the air volume located therein, i.e. the positive pressure fed from the second cavity 3, can escape at this stage, until bending of the sole takes place, without a lot of deformation energy being required.

FIG. 8 shows a schematic illustration of an initiating mechanism 19 for the valve 9 in a movement phase in which initiation has not yet taken place. By virtue of this initiating mechnism 19, it is only in the state of pronounced bending of the sole 1, in the closed state of the gap 5 according to FIG. 5, that the valve 9 is opened and in the state in which the gap has been relieved of pressure, according to FIG. 3, the valve 9 is closed again in order thus to reproduce the initial state according to FIG. 2. The adjusting screw 14 in channel 15, which screw presses on the initiator (valve pin) of the valve 9, and allows air to be let into line 8, during bending of the sole, can set precisely the point in time at which opening takes place.

Alternatively, the valve 9 may also be controlled via an initiating mechanism which reacts to the pressure with which the sole bears on the ground in the ball-of-the-foot region.

A further advantage of the device according to the invention consists in that the air emerging from the chamber 4 need not be discharged into the surroundings in an unutilized state; rather, said air can be directed into the interior of the shoe via a corresponding line 10, with the result that it displaces the sweat-containing air from there and ensures drying and cooling of the foot. A corresponding principle is indicated by the illustration of the line 10 in FIG. 1.

In order to ensure optimum widening of the gap 5, the third cavity 4 has to have its main application surface at the top edge of the gap 5, in order that the greatest possible lever can be utilized. It is preferable for an oval design of the cavity 4 to be selected, but alternatively, for stability reasons, it is also possible for a tube-like or wedge-shaped design having the greatest extent in the top region to be advantageous. The walls of the gap 5 itself should consist of relatively strong material, in order to convert the amount of pressure applied by the cavity 4 into the bending-back action of the sole in a loss-free manner as far as possible, for which purpose it may also be favorable for those regions of the sole which are adjacent to the gap likewise to be formed from relatively strong material. Since the foot subjects the sole to barely any loading, if any at all, at this location, the corresponding stronger formation of the sole material at this location is of no importance as far as walking comfort is concerned. In order to design the gap itself to be stronger, the gap termination, about which the two sole parts move during the corresponding bending movement and which ends about halfway through the thickness of the sole, must of course consist of a flexible material, for which purpose, for the sake of simplicity, an additional sole 13 made of a flexible material is adhesively bonded on the strong sole 1 according to the invention, thus forming a type of "hinge".

In a variant which is more straightforward to produce, the sole 1 is provided with its initiator in the manner according to the invention, but valve 9 is dispensed with. In this case, the line 8 has to be of such a length that the air running through the cavities without obstruction requires such a period of time to reach the third cavity 4 from the second cavity 3 that the air only enters into the third cavity 4 once said cavity has already been bent and/or the discharge of air therefrom has been completed.

In a more complex variant, the output can be increased by the additional introduction of a positive pressure from an external source. In the course of natural movement, this artificial positive pressure, along with the other positive pressures produced by the walker, results in a vastly improved pressure/movement output.

The device according to the invention ideally makes it possible, on the one hand, to damp the energy used when the foot is placed on the ground during a walking or running movement, and thus to relieve the walker's leg and hip joints of loading, and, on the other hand, to aid the walking movement itself in an active manner, in the [sic] at least some of the stored and enhanced energy used when the foot is placed on the ground is discharged at an anatomically expedient location of action in conjunction with additional ventilation of the shoe. The forward angular momentum which is produced by the front part of the sole being raised as the sole 1 is forced to straighten out is intended to give the walker the slight feeling that the shoe is actively aiding him/her; in particular the forward angular momentum can also assist the following-on action of the leg.

LIST OF DESIGNATIONS

1 Sole
2 First cavity in the heel region
3 Second cavity in the ball-of-the-foot region/intermediate pressure-storage space
4 Third cavity in the bending region
5 Gap
6 Line
7 Valve
8 Line
9 Valve
10 Line/discharge line
11 Line
12 Valve
13 Outsole
14 Adjusting screw
15 Channel
16 Configuration of cavity 3
17 Blocking mechanism
18 Outlet opening
19 Initiating mechanism

What is claimed is:

1. Shoe sole which, in the heel region, has a first cavity and, in the ball-of-the-foot region has a deformable second cavity, the two cavities being connected to one another and the outside air via lines, said lines being in communication with valves that are operable between an open position and a closed position wherein, a) provided in a bending region of the sole is a transversely running, downwardly closed gap, which includes therein a deformable third cavity, the third cavity being connected to the second cavity via a first line which is in communication with a first valve that is operable between an open position and a closed position and has at least one discharge line to outside air, said discharge line in communication with a blocking mechanism that is operable between an open position and a closed position;

b) the second cavity is separated off by valves and acts as an intermediate pressure-storage space;

c) provided that, when the heel region is subjected to loading, a second line connecting the first cavity to the outside air is closed by a second valve, a third line connecting the first cavity is open, the first line connecting the third cavity, is closed and the discharge line from the third cavity is open;

d) further provided that, when the heel region is relieved of loading and the ball of the foot is subjected to loading, the second line from the first cavity to the outside air is open and the third line to the second cavity is closed, and, as a result of simultaneous bending of the sole, the gap and the third cavity are compressed and the first line to the second cavity and the discharge line from the third cavity are closed by a blocking mechanism;

e) once the sole has been bent and the gap has been closed, an initiating mechanism opens the first line from the second cavity to the third cavity and closes the discharge line at the third cavity to the outside air, the third line from the first cavity to the second cavity being closed and the second line to the outside air being open;

f) when the sole is straightened out and the gap is again opened, the first line and the second line are closed and the discharge line of the third cavity is opened by the blocking mechanism to reproduce the state for the loading of the heel region according to c).

2. A shoe sole according to claim 1, wherein the valves are non-return valves.

3. A shoe sole according to claim 1, wherein the initiating mechanism is set in the first line.

4. A shoe sole according to claim 3, wherein the initiating mechanism includes a time delay.

5. A shoe sole according to claim 1, wherein, in the top region of the gap, the third cavity is wedge-shaped, round or oval shaped.

6. A shoe sole according to claim 1, wherein the discharge line of the third cavity, in the gap, leads into the interior of the shoe.

7. A shoe sole according to claim 1, wherein the walls of the gap and the adjacent regions of the sole are formed from a non-flexible material.

8. A shoe sole according to claim 7, wherein a flexible outsole is provided beneath the sole.

9. A shoe sole according to claim 1, wherein the second cavity is anatomically adapted in accordance with the centers of gravity of the bearing pressure of the ball of the foot.

10. A shoe sole according to claim 1, wherein the first cavity is connected to a portable, controllable positive-pressure oxygen chamber by a valve with a bearing-pressure initiating mechanism including an outwardly leading line.

11. A shoe sole according to claim 5, wherein the third cavity includes a blocking mechanism which comprises mutually opposite, wall-like inwardly directed projections which, depending on the compression or expansion of the cavity, interengage to a more or less pronounced extent.

12. A shoe sole according to claim 3, wherein the initiating mechanism includes an adjusting screw that acts on the first valve, said adjusting screw being provided in a channel located laterally on the outer border region of the sole, parallel to the longitudinal axis.

13. A shoe sole according to claim 1, further comprising that the first valve and the initiating mechanism are replaced in the gap by an extended line of such a length that bending of the sole is achieved at a point in time before the unobstructed throughflow of air through this line into the third cavity.

14. A shoe sole according to claim 7, wherein a flexible outsole is provided beneath the sole and holds the sole gap together.

15. A shoe sole according to claim 3, wherein the initiating mechanism includes an adjusting screw that acts on the first valve, said adjusting screw being provided in a channel located laterally on the outer border region of the sole, and oblique to the longitudinal axis.

* * * * *